US012049350B2

(12) United States Patent
Singh et al.

(10) Patent No.: US 12,049,350 B2
(45) Date of Patent: Jul. 30, 2024

(54) ENCLOSURE ASSEMBLY HAVING A RESEALABLE ENCLOSURE WITHIN AN OUTER BOX ENCLOSURE

(71) Applicant: Illinois Tool Works Inc., Glenview, IL (US)

(72) Inventors: Komal Singh, Milwaukee, WI (US); Lars Wihlborg, Stratford, CT (US); Jose Septien, Naperville, IL (US); Eric Plourde, Frankfort, IL (US)

(73) Assignee: ILLINOIS TOOL WORKS INC, Glenview, IL (US)

( * ) Notice: Subject to any disclaimer, the term of this patent is extended or adjusted under 35 U.S.C. 154(b) by 621 days.

(21) Appl. No.: 17/066,018

(22) Filed: Oct. 8, 2020

(65) Prior Publication Data

US 2021/0107718 A1 Apr. 15, 2021

Related U.S. Application Data

(60) Provisional application No. 62/913,584, filed on Oct. 10, 2019.

(51) Int. Cl.
*B65D 33/25* (2006.01)
*B65D 5/70* (2006.01)
(Continued)

(52) U.S. Cl.
CPC ..... *B65D 77/065* (2013.01); *B65D 5/703* (2013.01); *B65D 33/25* (2013.01)

(58) Field of Classification Search
CPC ..... B65D 33/25; B65D 33/2508; B65D 33/2516; B65D 33/2525; B65D 33/2533;
(Continued)

(56) References Cited

U.S. PATENT DOCUMENTS 4,782,951 A 11/1988 Greisbach et al.
5,088,164 A 2/1992 Wilson et al.
(Continued)

OTHER PUBLICATIONS

Velcro Industries B.V. "Press-Lok for Flexible Packaging, the Smart Closure for Bags and Pouches", EU Web brochure, 2012 (6 pages).
(Continued)

*Primary Examiner* — Jes F Pascua
*Assistant Examiner* — Nina K Attel
(74) *Attorney, Agent, or Firm* — The Small Patent Law Group LLC; Christopher R. Carroll

(57) ABSTRACT

Enclosure assembly includes an outer box enclosure and a flexible, resealable enclosure that is disposed within the outer box enclosure. The resealable enclosure has a resealer formed by a single intermeshable closure member that is affixed to and wraps from a front side of the outer box enclosure, around at least one of side edge of the outer box enclosure, and onto a back side of the resealable enclosure. Prior to initially opening the resealable enclosure, the intermeshable closure member is uncoupled with itself. The intermeshable closure member is configured to couple with itself at a first area of the intermeshable closure member that is on the front side of the resealable enclosure and at a different, second area of the intermeshable closure member that is on the back side of the resealable enclosure to close the resealable enclosure.

20 Claims, 9 Drawing Sheets

(51) Int. Cl.
*B65D 77/04* (2006.01)
*B65D 77/06* (2006.01)

(58) Field of Classification Search
CPC ..... B65D 33/2541; B65D 33/255; B65D 33/2558; B65D 33/2566; B65D 33/2575; B65D 33/2583; B65D 33/2584; B65D 33/2585; B65D 33/2586; B65D 33/25865; B65D 33/2587; B65D 33/2588; B65D 33/2589; B65D 33/259; B65D 33/2591; B65D 77/062; B65D 77/064; B65D 77/065; B65D 5/703
USPC ..... 229/117.27, 117.3
See application file for complete search history.

(56) References Cited

U.S. PATENT DOCUMENTS

| | | | | |
|---|---|---|---|---|
| 5,113,555 | A | 5/1992 | Wilson et al. | |
| 5,212,855 | A | 5/1993 | McGanty | |
| 5,238,306 | A | 8/1993 | Heintz et al. | |
| 5,435,864 | A | 7/1995 | Machacek et al. | |
| 5,806,984 | A | 9/1998 | Yeager | |
| 6,389,651 | B2 | 5/2002 | Johnson | |
| 6,416,221 | B2 | 7/2002 | Price | |
| 6,971,794 | B2 | 12/2005 | Yeager | |
| 7,097,092 | B1 | 8/2006 | Marrale | |
| 9,745,103 | B2 * | 8/2017 | Greco | B65D 33/2508 |
| 2007/0230834 | A1 * | 10/2007 | Schneider | B65D 33/2541 383/906 |
| 2008/0135605 | A1 | 6/2008 | Manaige | |
| 2010/0144507 | A1 * | 6/2010 | Yeager | B65B 61/184 493/212 |
| 2011/0095075 | A1 * | 4/2011 | Pinkstone | B65D 5/742 229/162.1 |
| 2015/0251831 | A1 | 9/2015 | Steele | |
| 2015/0368019 | A1 * | 12/2015 | Pinkstone | B65D 5/743 53/452 |
| 2021/0139217 | A1 * | 5/2021 | Bogdanov | B65D 75/5855 |

OTHER PUBLICATIONS

Velcro Industries B.V. "Packaging Solutions, Press-Lok 700 Series, Innovative Reclose Fastener", EU Web brochure, 2013 (2 pages).
International Preliminary Report on Patentability mailed Apr. 21, 2022 for corresponding Application No. PCT/US2020/055075 (11 pages).
International Search Report and Written Opinion mailed Dec. 18, 2020 for corresponding Application No. PCT/US2020/055075 (16 pages).

* cited by examiner

ENCLOSURE ASSEMBLY HAVING A RESEALABLE ENCLOSURE WITHIN AN OUTER BOX ENCLOSURE

CROSS-REFERENCE TO RELATED APPLICATIONS

This application claims priority to U.S. Provisional Application No. 62/913,584, which was filed on 10 Oct. 2019, and the entire disclosure of which is incorporated herein by reference.

FIELD

The subject matter of the present application relates to enclosure assemblies having a resealable enclosure that may be disposed within an outer box enclosure.

BACKGROUND

A resealable enclosure enables a user to repeatedly open the enclosure, remove a portion of the contents from the enclosure, and then close the enclosure in a manner that seals the contents therein. More recently, mechanisms for resealing have been incorporated with more flexible enclosures (e.g., box liners, plastic bags, and the like). In many cases, these resealable enclosure are irreparably altered when initially opened (e.g., by tearing an opening into the enclosure), but the resealable enclosure is configured to effectively close (or reseal) the opening to protect the contents from the surrounding environment and/or prevent the contents from inadvertently exiting the enclosure. Mechanisms that may be used to reseal an enclosure include fastener strips, cooperating adhesive strips, hook-and-loop fastener elements, and the like.

Resealable enclosures have become more popular because such enclosures can provide sufficient protection of the contents therein while being relatively convenient. Compared to user-improvised methods (e.g., rolling the top of a flexible bag), resealable enclosures are tidier and reassure the user that the contents are protected and will not spill if the enclosure is mispositioned or dropped. For food items, such as grain, chips, nuts, and the like, resealable enclosures can uphold the freshness of the food longer than the user-improvised methods.

Although resealable enclosures have been effective in allowing users to repeatedly open, seal, and reopen them, the operation of at least some known enclosures may not be quickly understood and/or may be challenging for one or more users to handle. For example, prior to initially opening the enclosure, the user may fail to recognize that the enclosure is resealable. In such instances, the user may initially open the enclosure in a manner that damages the resealing mechanism. Even when a user knows that the enclosure is resealable, it may be difficult to understand how to initially open the enclosure without damaging the resealing mechanism.

In addition to the above, it can be difficult to recognize how to remove the contents (e.g., serve the contents) after the enclosure is opened. Instead of pouring the contents from an enclosure, some users (e.g., children) may choose to insert their hand into the enclosure to pull the contents out of the enclosure. This may be undesirable with respect to hygiene. Often, a user may remove the entire resealable enclosure from within the outer enclosure, such as when a cereal bag is removed from the outer paperboard box. But once removed from the outer enclosure, the contents in the inner enclosure can be more susceptible to damage.

Moreover, the contents may be difficult to identify when removed from the outer enclosure because, in many cases, information identifying or characterizing the contents is only provided along an exterior surface of the outer enclosure. If the inner enclosure is used without the outer enclosure, the manufacturers of the product may lose valuable commercial interactions in which the user becomes more familiar with the brand or in which the user views other marketing, such as when a cereal box advertises other events (e.g., motion pictures).

BRIEF DESCRIPTION

In one or more embodiments, the enclosure assembly includes an outer box enclosure. The outer box enclosure may be configured to break along a line of weakness to form an outer opening into an interior volume of the outer box enclosure. Alternatively, the outer box enclosure is not configured to break along a line of weakness. Instead, the outer box enclosure may bend about or around a fold in the outer box enclosure that forms a hinge. This can allow the outer box enclosure to be repeatedly opened and closed as the outer box is not broken along a line of weakness. The enclosure assembly also includes a flexible, resealable enclosure disposed within the outer box enclosure. The resealable enclosure may be configured to be initially opened by separating (e.g., rupturing or peeling) a portion of the resealable enclosure, thereby forming an inner opening along a top edge of the resealable enclosure through which contents of the resealable enclosure are poured. In other embodiments, the resealable enclosure may not be ruptured.

The resealable enclosure can include a resealer that extends along the top edge. The resealer may be located at the top edge or near the top edge. The resealer permits a user to open the inner opening and sealably close the inner opening. Optionally, the resealer may be positioned within an accessible space of the outer box enclosure.

In at least one embodiment, an enclosure assembly is provided. The enclosure assembly includes an outer box enclosure having opposite front and back panels and opposite lateral panels coupled by a top panel. The outer box enclosure can have a line of weakness to permit a breakable section of the outer box enclosure to be separated from another portion of the outer box enclosure. The breakable section may include the top panel. Alternatively, the outer box enclosure is not configured to break along a line of weakness. Instead, the outer box enclosure may bend about or around a fold in the outer box enclosure that forms a hinge. This can allow the outer box enclosure to be repeatedly opened and closed as the outer box is not broken along a line of weakness. The enclosure assembly also includes a flexible, resealable enclosure that is disposed within the outer box enclosure. The resealable enclosure has opposite front and back sides sealed to each other along a bottom edge and opposite side edges. The resealable enclosure having a resealer formed by a single intermeshable closure member that is affixed to and wraps from the front side, around at least one of the side edges, and onto the back side proximate to an upper edge of the resealable enclosure. Prior to initially opening the resealable enclosure, the intermeshable closure member is uncoupled with itself. The intermeshable closure member is configured to couple with itself at a first area of the intermeshable closure member that is on the front side of the resealable enclosure and at a different, second area of the intermeshable closure member that is on the back side of the resealable enclosure to close the resealable enclosure.

In some aspects, the intermeshable closure member extends from a first end on the front side of the resealable enclosure to an opposite, second end on the back side of the resealable enclosure. Optionally, the front side and the back side of the resealable enclosure are sealed to each other in a location that is proximate to the first end and the second end of the intermeshable closure member.

In some aspects, the intermeshable closure member is configured to be re-coupled with itself after opening the resealable enclosure.

In some aspects, the intermeshable closure member is configured to be re-coupled with itself with the resealable enclosure wrapping from the front side, around a gusset, and onto the rear side. Optionally, the intermeshable closure member is configured to be re-coupled with itself after opening the resealable enclosure in a flat configuration that does not include the gusseted configuration.

In some aspects, the intermeshable closure member is configured to be re-coupled with itself after opening the resealable enclosure in a gusseted configuration. Alternatively, the resealable enclosure may not re-couple in a gusseted configuration. Stated differently, the resealable enclosure may not have a gusset when closed or re-closed after opening.

In some aspects, the line of weakness in the outer box enclosure extends around and forms a perimeter of the breakable section of the outer box enclosure such that the breakable section is removed from the outer box enclosure along the line of weakness. Alternatively, the outer box enclosure does not break along the line of weakness and no portion of the outer box enclosure is removed. Instead, the outer box enclosure may fold around, about, or along a line or lines to form a hinge that allows the outer box enclosure to repeatedly open and close. In another embodiment, the outer box enclosure may open along an entire width and length of a top side of the outer box enclosure.

In some aspects, the line of weakness in the outer box enclosure extends around part, but not all, of the breakable section of the outer box enclosure such that the breakable section remains coupled to the outer box enclosure along a hinge interface between the breakable section and a remainder of the outer box enclosure.

In some aspects, the top panel of the outer box enclosure is at least partially formed by hinged sides coupled to the front and back panels of the outer box enclosure, and the line of weakness in the outer box enclosure extends from the front panel across the top panel to the back panel to permit the hinged sides to open and provide access into the outer box enclosure.

In some aspects, the resealable enclosure forms the shape of the outer box enclosure by middle portions of the front and back sides of the resealable enclosure extending toward opposing interior surfaces of the front and back panels of the outer box enclosure and by end portions of the front and back sides extending toward an interior surface of one of the lateral panels of the outer box enclosure.

In some aspects, the breakable section of the outer box enclosure is separated from at least the top panel of the outer box enclosure to create an opening into an interior volume of the outer box enclosure, wherein the resealable enclosure is larger than the opening created by separation of the breakable section while the resealable enclosure is filled with a product.

In at least one embodiment, an enclosure assembly is provided that includes an outer box enclosure having opposite front and back panels coupled by a top panel. The outer box enclosure having a line of weakness, and can be configured to partially or entirely break or tear along the line of weakness to form an outer opening along the top panel. If the outer box enclosure entirely breaks or tears along the line of weakness, then a non-recloseable opening can be formed in the outer box enclosure. If the outer box enclosure only partially breaks or tears along the line of weakness, then a recloseable opening can be formed in the outer box enclosure (that may be opened and closed repeatedly by folding the outer box enclosure about a hinge). The enclosure assembly also includes a flexible, resealable enclosure disposed within the outer box enclosure. The resealable enclosure has opposite front and back sides coupled to each other along opposite top and bottom edges. The resealable enclosure also includes opposite first and second side edges extending between the front and back sides. The first side edge is a gusseted side edge, wherein the resealable enclosure is configured to be initially opened by separating a portion of the resealable enclosure, thereby forming an inner opening along the top edge through which contents of the resealable enclosure are poured. The resealable enclosure includes a resealer that extends along the top edge from the first side edge toward the second side edge. The resealer permits a user to open the inner opening and sealably close the inner opening. The first side edge includes a gusseted section that is configured to be displaced from an inward state to an outward state. Alternatively, the first side edge may not include a gusseted section. The first side edge forms a spout that defines a portion of the inner opening when the gusseted section is in the outward state. The spout is positionable adjacent to or within the outer opening.

In some aspects, the front and back panels are coupled through a lateral panel. The line of weakness includes a first line of weakness along the front panel, a second line of weakness along the back panel, and a third line of weakness along the lateral panel. The first, second, and third lines of weakness form a breakable section. The breakable section defines an accessible space of an interior volume of the outer box enclosure. The resealer is positionable within the accessible space when the resealable enclosure is held by the outer box enclosure.

In some aspects, the resealable enclosure has a width extending between the first and second side edges. The width of the resealable enclosure having the spout is greater than the width of the resealable enclosure prior to initially opening the resealable enclosure.

In some aspects, the front and back panels are coupled through a lateral panel. The first side edge extends toward the lateral panel when the first side edge forms the spout.

In some aspects, the resealable enclosure has a width extending between the first and second side edges. The resealer extends only a portion of the width between the first and second side edges. The top edge is closed for a remaining portion of the top edge In some aspects, the resealer includes at least one of an intermeshable closure member, parallel fastener strips, cooperating adhesive strips, hook-and-loop fastener elements, or a slider.

In some aspects, the resealer includes an intermeshable closure member, wherein, prior to initially opening the resealable enclosure, the intermeshable closure member is uncoupled with itself. The intermeshable closure member is configured to couple with itself at a first area of the intermeshable closure member that is on the front side of the resealable enclosure and at a different, second area of the intermeshable closure member that is on the back side of the resealable enclosure to close the resealable enclosure. Optionally, the intermeshable closure member extends from a first end on the front side of the resealable enclosure to an opposite, second end on the back side of the resealable enclosure.

BRIEF DESCRIPTION OF THE DRAWINGS

The inventive subject matter will now be illustrated with reference to the following figures, in which.

DETAILED DESCRIPTION

Figure 2:
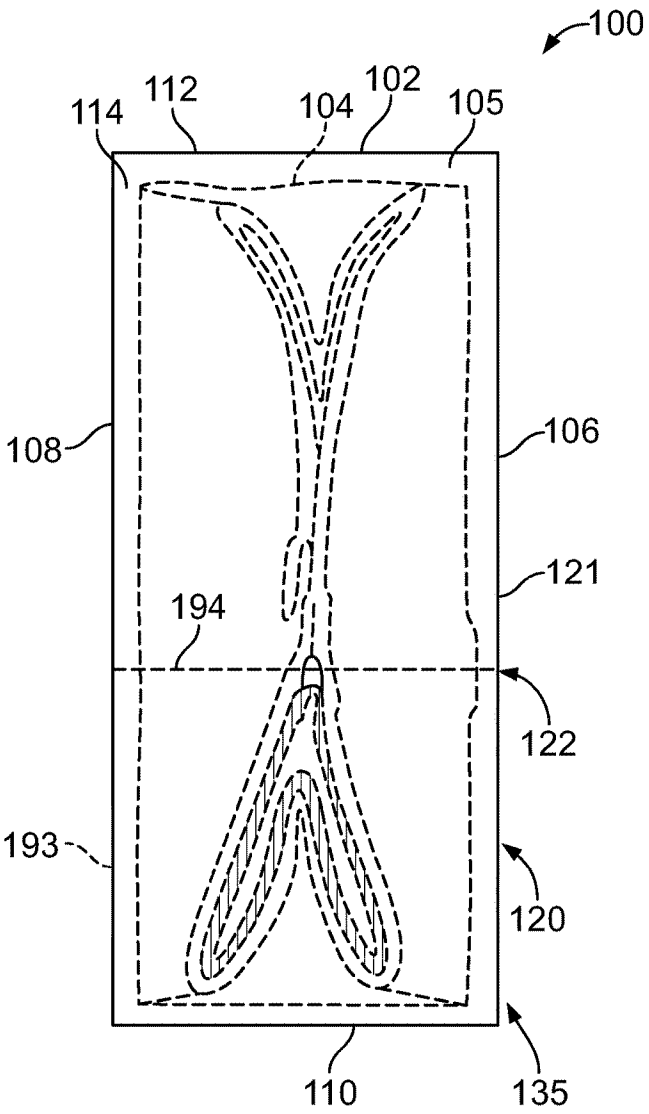
FIG. 2 is a top view of the enclosure assembly of FIG. 1.

Embodiments set forth herein include an enclosure assembly and methods of making or assembling the same. The enclosure assembly includes an outer box enclosure. Optionally, a portion of the outer box enclosure may be moved relative to a remaining portion of the outer box enclosure to reveal an accessible space. For example, the outer box enclosure may be configured to break along a line of weakness to form an outer opening into an interior volume of the outer box enclosure.

The enclosure assembly may also include a flexible, resealable enclosure disposed within the outer box enclosure. In certain embodiments, the resealable enclosure is configured to be initially opened by separating a portion of the resealable enclosure, thereby forming an inner opening along a top edge of the resealable enclosure. Contents (e.g., consumables) may be passable through the inner opening of the resealable enclosure. The resealable enclosure may include a resealer that extends along the top edge. The resealer permits a user to open the inner opening and sealably close the inner opening.

In certain embodiments, a user may more readily understand how the resealable enclosure operates. For example, the outer box enclosure may include a breakable section that at least partially breaks from the outer box enclosure. The breakable section may, for example, include at least a portion of a corner of the outer box enclosure. When the breakable section is moved (e.g., removed entirely or rotated away from its original position prior to breaking), a portion of the interior volume may be revealed to the user. This portion of the interior volume may be referred to as the accessible space. The remaining portion of the interior volume may be referred to as the covered or enclosed space. In some embodiments, the accessible space represents a former portion of the enclosed interior volume that is now accessible without requiring the user to insert his or her hand through the outer opening.

An operative portion of the resealable enclosure may be disposed within or occupy the accessible space. The operative portion of the resealable enclosure represents the portion of the resealable enclosure that may be opened and sealably closed. With only the operative portion revealed and positioned within the accessible space, the user may more quickly understand that the operative portion should be used to open the resealable enclosure, pour contents from the resealable enclosure, and sealably close the resealable enclosure.

In some embodiments, the operative portion of the resealable enclosure may be positioned adjacent to or within the accessible space when the resealable enclosure is held by the outer box enclosure. The operative portion may include the resealer. As used herein, the operative portion (or the resealer) is positionable adjacent to or within the accessible space if the operative portion (or the resealer) is viewable to the user when the breakable section is moved and when the resealable enclosure has not had any of the contents removed. Optionally, the operative portion of the resealable enclosure may clear the outer opening that is formed when the breakable section of the outer box enclosure is moved.

In certain embodiments, the operative portion of the resealable enclosure may appear to replace a corner of the enclosure assembly or resemble a corner of the enclosure assembly. In such instances, the user may more readily identify the operative portion of the resealable enclosure as the portion that is to be used to remove (e.g., pour) the contents from the enclosure assembly.

Even if the operative portion of the resealable enclosure is not positioned within the accessible space, the operative portion, compared to other portions of the resealable enclosure, may be the more readily gripped portion. For example, if the user inserts his or her hand through the accessible space and into the interior volume of the outer box enclosure, the operative portion may be the first portion of the resealable enclosure that the user feels. The operative portion may be the portion of the resealable enclosure that is configured to be pulled into the accessible space by the user.

In certain embodiments, the outer opening that provides access into the interior volume of the outer box enclosure may be configured (e.g., sized and shaped) to block the resealable enclosure from being pulled entirely through the outer opening when the resealable enclosure has not been initially opened and/or the resealable enclosure is filled with the intended volume of contents. Even when the contents have been partially removed, the outer opening may be configured to impede or hinder removal of the resealable enclosure. Accordingly, at least some embodiments may increase the likelihood that the resealable enclosure remains within the outer box enclosure. As such, the contents may remain protected. Moreover, because the outer box enclosure is less likely to be discarded before the contents are depleted and, thus, more likely to be viewed by individuals, embodiments may enhance the value of the exterior surface of the outer box enclosure.

Alternatively or in addition to the above, the outer opening may be configured to impede or hinder insertion of a user's hand into the interior volume. For example, although the outer opening may permit the user to insert his or her fingers into the interior volume, it may be more difficult to insert his or her entire hand into the interior volume. As such, the enclosure assembly may be more hygienic than other known enclosures.

In particular embodiments, the resealer is an intermeshable closure member. The intermeshable closure member may extend along an interior surface of the resealable enclosure from the front side to the back side such that the intermeshable closure member may engage itself. It should be noted, however, that other resealers are contemplated and may replace the intermeshable closure member or be used in addition to the intermeshable closure member. For example, the resealer may include at least one of an intermeshable closure member, parallel fastener strips, cooperating adhesive strips, hook-and-loop fastener elements, zipper, or a slider or a combination thereof. The resealer may include, for example, a track and a strip on opposing surfaces of the enclosure in which the strip fits within and along the track. Optionally, the resealer may include two tracks and two strips in which each track receives one strip.

As another example, the resealer may include two opposing hook-filled lanes or strips. When brought together, the hooks of one lane couple to the hooks of the opposing lane, thereby sealing the enclosure. The hooks could be configured to engage on multiple levels. Optionally, the width of the lanes may be configured so that precise alignment is not required. The hooks may provide an audible and tactile response when the lanes are brought together for closing.

Figure 1:
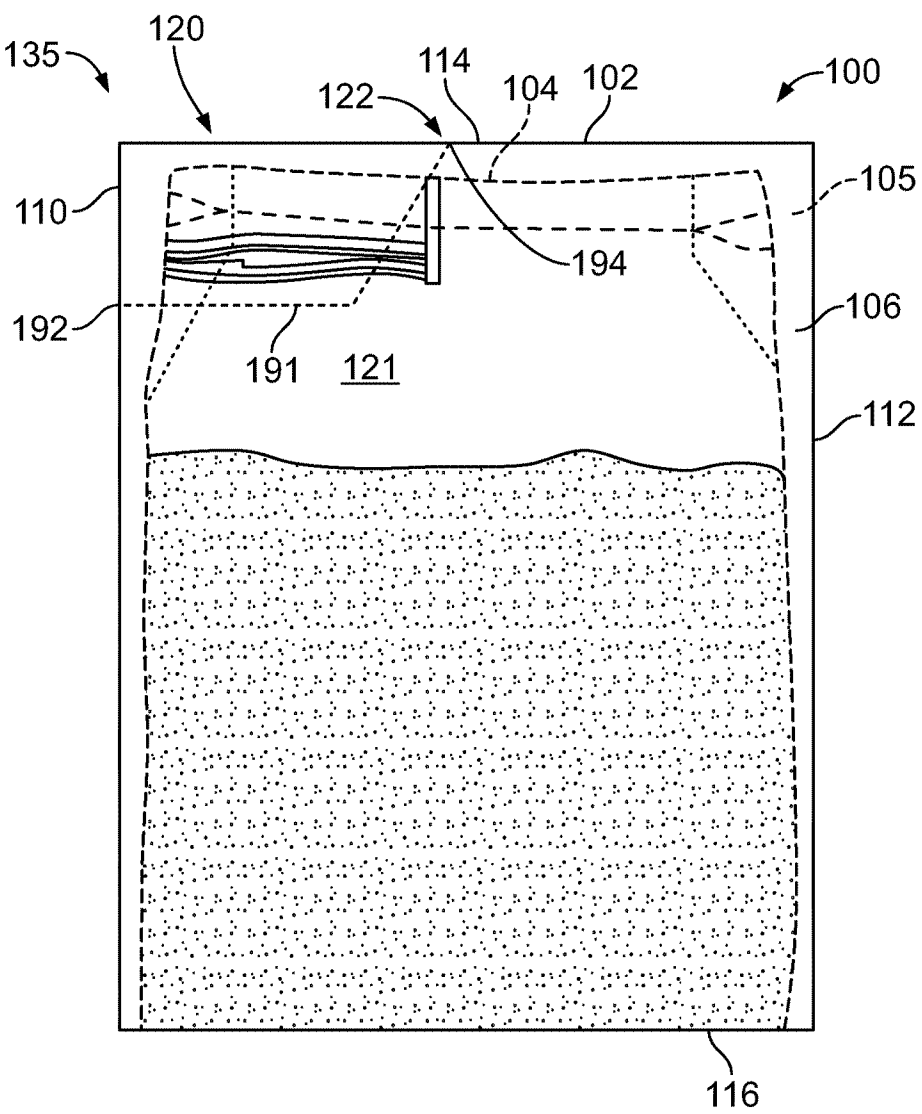
FIG. 1 is a side view of an enclosure assembly that includes an outer box enclosure and a flexible, resealable enclosure disposed within the outer box enclosure in accordance with an embodiment.

FIGS. 1 and 2 are a side view and a top view, respectively, of an enclosure assembly 100. The enclosure assembly 100 includes an outer box enclosure 102 and a flexible, resealable enclosure 104 that is disposed within the outer box enclosure 102. The outer box enclosure 102 may have more structural integrity than the resealable enclosure 104 and may be configured to maintain a predetermined shape. For example, the outer box enclosure 102 may comprise cardboard, paperboard, or a like material. As shown, the outer box enclosure 102 encloses an interior volume 105 such that the interior volume 105 is entirely surrounded or defined by the outer box enclosure 102. As described below, one or more sections of the outer box enclosure 102 may be separable from the outer box enclosure 102. When separated from the outer box enclosure 102, the outer box enclosure 102 may no longer entirely surround or define the interior volume 105.

Figure 4:
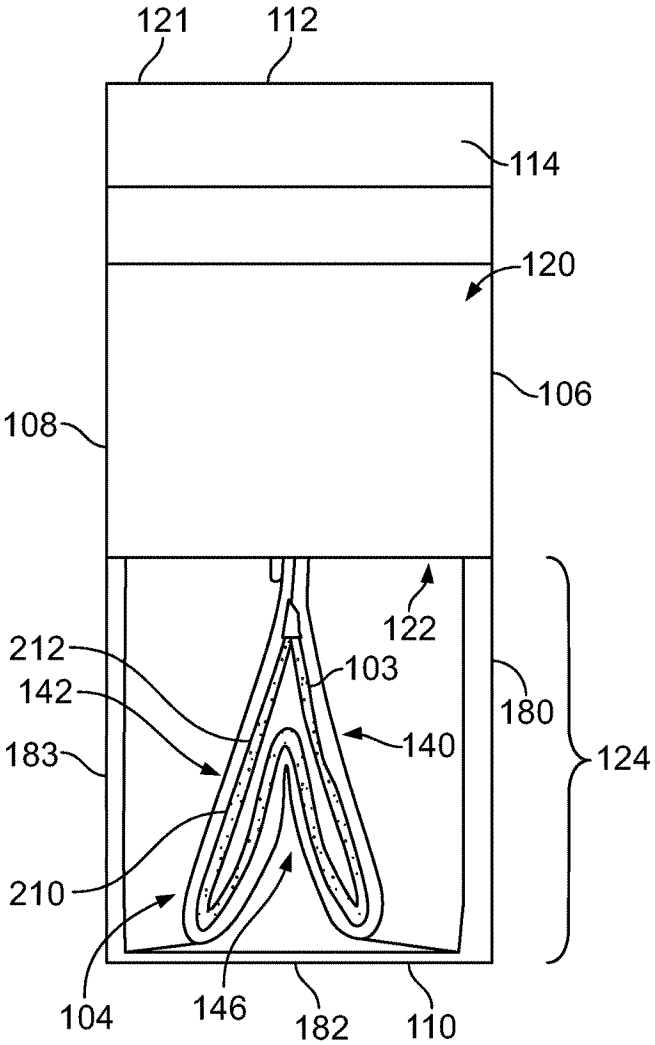
FIG. 4 is a top view of the enclosure assembly of FIG. 1 after the breakable section of the outer box enclosure has been moved.
Figure 3:
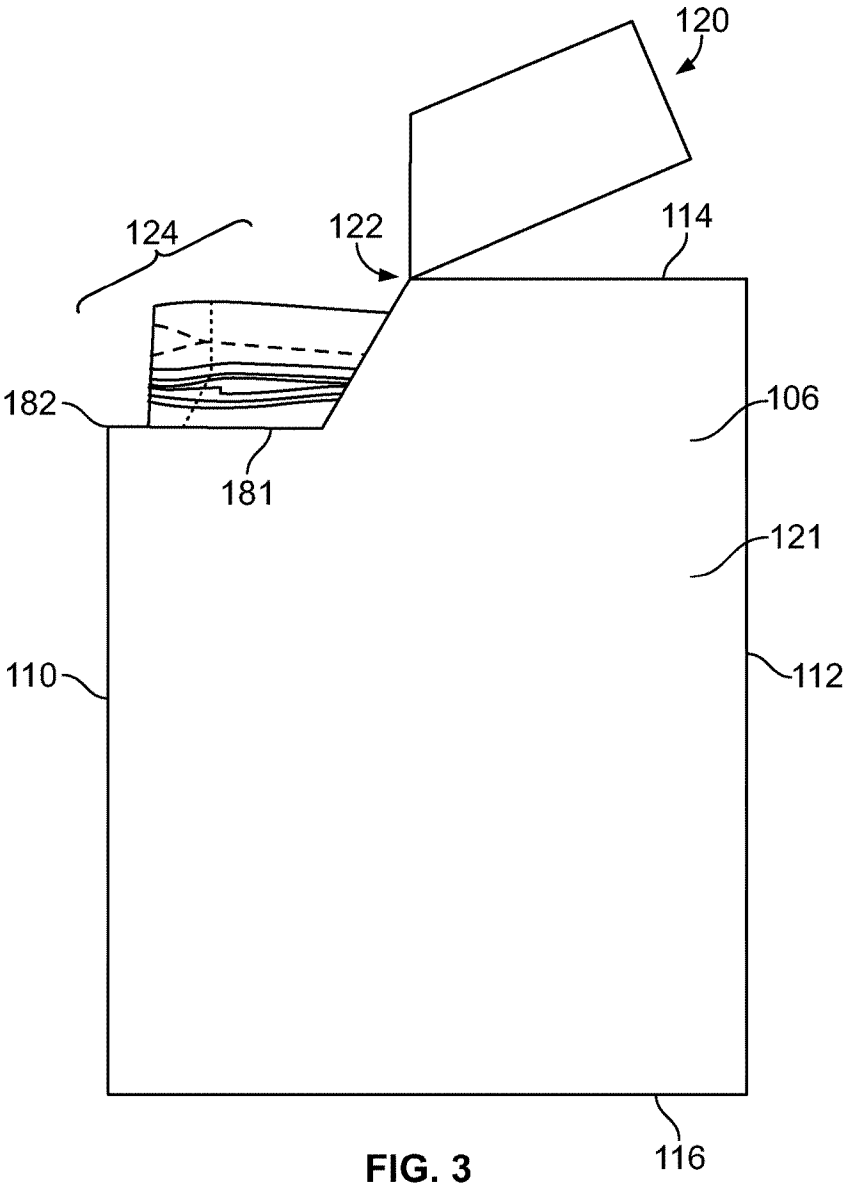
FIG. 3 is a side view of the enclosure assembly of FIG. 1 after a breakable section of the outer box enclosure has been moved, wherein a portion of the resealable enclosure occupies an accessible space that was covered by the breakable section.

FIGS. 3 and 4 are also a side view and a top view, respectively, of the enclosure assembly 100. FIGS. 3 and 4, however, do not illustrate the interior volume 105 of the outer box enclosure 102 that remains enclosed. FIGS. 3 and 4 illustrate how the enclosure assembly 100 may appear to a user. Unless otherwise noted, the following is with respect to FIGS. 1-4.

In the illustrated embodiment, the outer box enclosure 102 has a first panel 106 and a second panel 108 (shown in FIGS. 2 and 4), which are hereinafter referred to as front and back panels 106, 108. As shown, the front and back panels 106, 108 are on opposite sides of the outer box enclosure 102 and face away from each other. The outer box enclosure 102 may also include third and fourth panels 110, 112, which are hereinafter referred to as lateral panels 110, 112. The lateral panels 110, 112 are opposite sides that generally face away from each other. The front and back panels 106, 108 are substantially larger than the lateral panels 110, 112 in the illustrated embodiment and may be referred to as broad panels or front and back faces, respectively, of the outer box enclosure 102. The lateral panel 110 extends between and couples the front and back panels 106, 108. The lateral panel 112 also extends between and couples the front and back panels 106, 108.

The outer box enclosure 102 also includes a fifth panel 114 and a sixth panel 116 (FIGS. 1 and 3), which are hereinafter referred to as a top panel 114 and a bottom panel 116, respectively. The top and bottom panels 114, 116 also extend between and couple the front and back panels 106, 108. The bottom panel 116 extends between and couples the lateral panels 110, 112. Prior to opening the outer box enclosure, the top panel 114 extends between and couples the lateral panels 110, 112.

In the illustrated embodiment, the outer box enclosure 102 is a rectangular box (e.g., cereal box) in which the panels 106, 108, 110, 112, 114, and 116 are planar panels or sides of the outer box enclosure 102. The outer box enclosure 102, however, may have other shapes in other embodiments. For example, the outer box enclosure 102 may have more than six panels or fewer than six panels. The outer box enclosure 102 may not be rectangular but another polygonal structure. Moreover, one or more of the panels may be non-planar such that the outer box enclosure 102 has a curved surface.

Also shown, the outer box enclosure 102 has a breakable or fragile section 120 that is separable from a remainder 121 (or remaining portion) of the outer box enclosure 102. In the illustrated embodiment, the breakable section 120 only partially separates from the remainder 121 of the outer box enclosure 102. The breakable section 120 remains attached to the remainder 121 along a hinge 122. In other embodiments, however, the breakable section 120 may be separated entirely from the remainder 121. When the breakable section 120 is partially or entirely separated from the remainder 121, an outer opening 124 (FIGS. 3 and 4) of the outer box enclosure 102 exists that provides access to the portion of the interior volume 105 that remains surrounded by the outer box enclosure 102. In the illustrated embodiment, the outer opening 124 is defined by edge 181 (FIGS. 3 and 4) of the front panel 106, edge 183 (FIG. 4) of the back panel 108, and edge 182 (FIGS. 3 and 4) of the lateral panel 110. The edges 181-183 may be frayed edges indicating the material has been torn or ruptured.

The breakable section 120 and the outer opening 124 may be determined by at least one line of weakness. For example, the outer box enclosure 102 includes a line of weakness 191 (FIG. 1) of the front panel 106, a line of weakness 193 (FIG. 2) of the back panel 108, and a line of weakness 192 (FIG. 1) of the lateral panel 110. A hinge line 194 extends along the top panel 114 between the front and back panels 106, 108. The lines of weakness 191-193 determine how the breakable section 120 separates from the remainder 121 of the outer box enclosure 102. For example, the user may grip a corner 135 (shown in FIGS. 1 and 2) of the outer box enclosure 102 and apply a force in a direction generally toward the lateral panel 112 and away from the top panel 114 to break the outer box enclosure 102 along the lines of weakness 191-193, thereby forming the breakable section 120.

In the illustrated embodiment, the hinge line 194 represents where the material of the top panel 114 that may fold to permit the breakable section 120 to rotate back and forth about the hinge 122 between open and closed positions. In other embodiments, the hinge line 194 may also be a line of weakness such that the entire breakable section 120 may be removed.

Alternatively, the entire top panel 114 of the outer box enclosure 102 may open. Instead of including the line of weakness 191 in the front panel 106, the line of weakness 193 in the back panel 108, and the line of weakness 192 of the lateral panel 110, the outer box enclosure 102 may include a line of weakness that extends along the length of the top panel 114 (e.g., from one lateral panel 110 to the opposite lateral panel 112). For example, the top panel 114 of the enclosure 102 may be formed from overlapping flaps with the line of weakness 192 being a temporary seal or coupling of the flaps that can be separated or torn by a consumer. One of these flaps can be coupled with the front panel 106 and extend from one lateral panel 110 to the other lateral panel 112. This flap can pivot about a hinge defined by the interface or fold between the flap and the front panel 106. Another flap can be coupled with the back panel 108 and extend from one lateral panel 110 to the other lateral panel 112. This flap can pivot about a hinge defined by the interface or fold between the flap and the back panel 108. One of these flaps can overlap the other flap to allow a consumer to open the top of the enclosure 102 by pulling or pivoting the flaps away from each other. This can allow for the entire top of the outer box enclosure 102 to open.

In another embodiment, the outer box enclosure 102 may be opened in another location. For example, the line of weakness(es) may be disposed in one or more panels so that the outer box enclosure 102 only opens along, in, or through the front panel 106, along, in, or through the back panel 108, or along, in, or through one or more of the lateral panels 110, 112.

Figure 6:
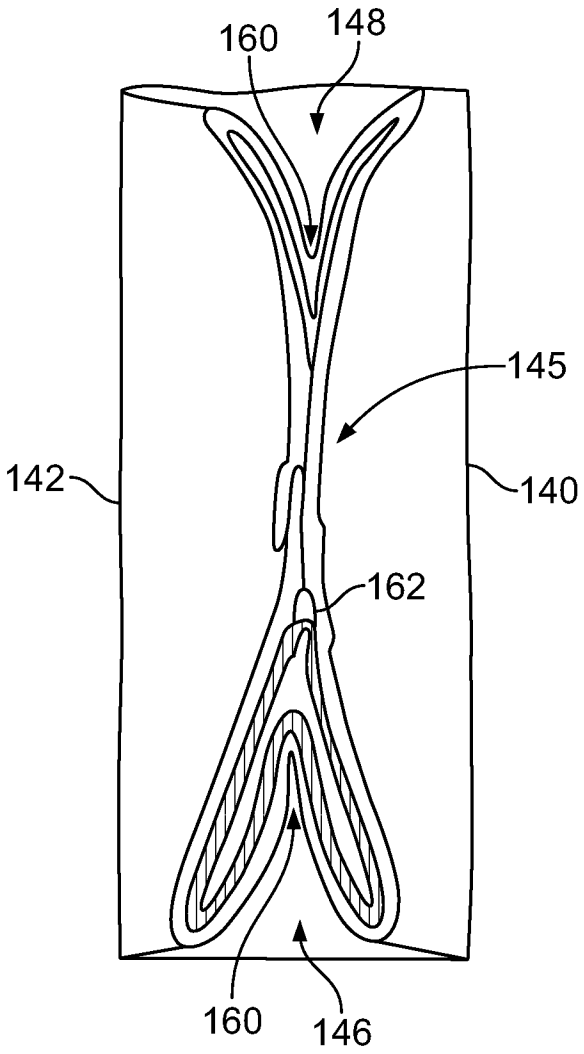
FIG. 6 is a top view of the resealable enclosure of FIG. 1 isolated from the outer box enclosure.
Figure 5:
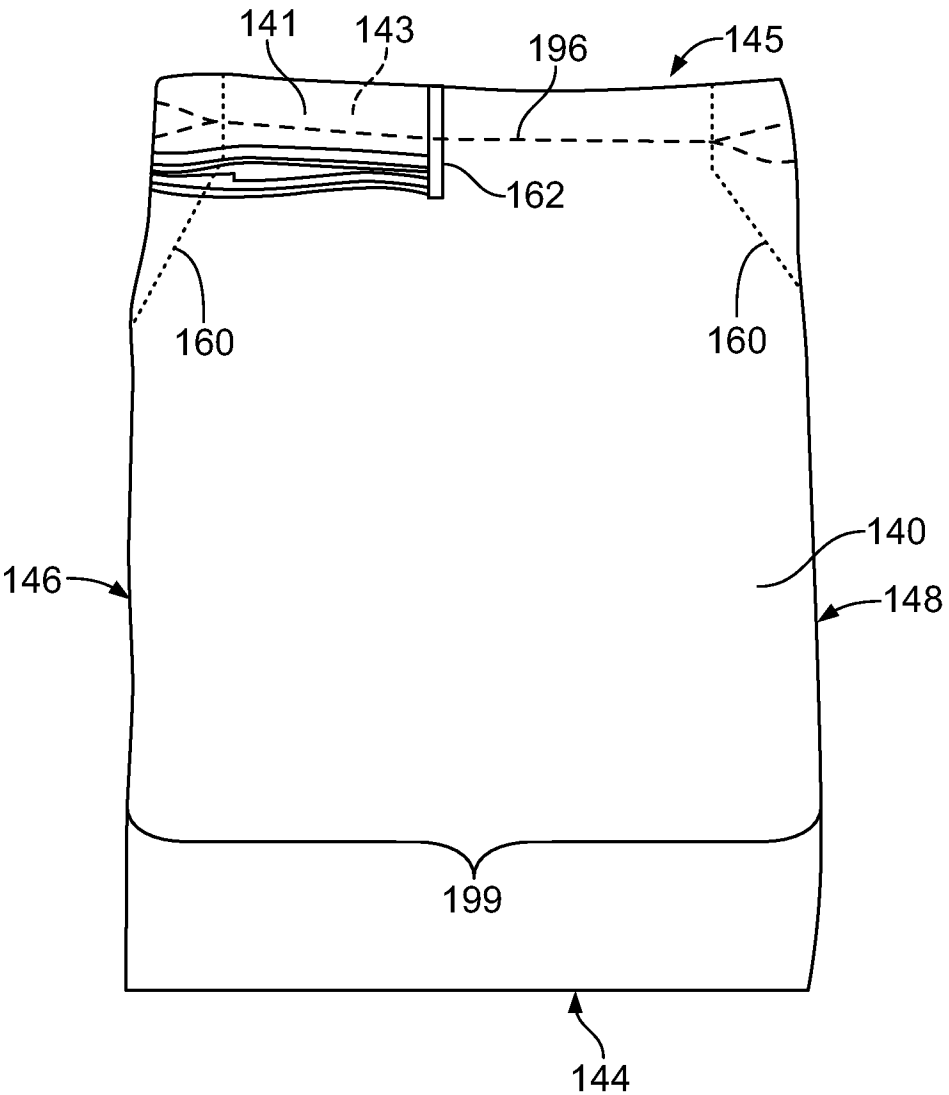
FIG. 5 is a side view of the resealable enclosure of FIG. 1 isolated from the outer box enclosure.

FIGS. 5 and 6 illustrate a side view and top view, respectively, of the resealable enclosure 104 when isolated from the outer box enclosure 102 (FIG. 1). In the illustrated embodiment, the resealable enclosure 104 has a first side 140 and a second side 142 (FIG. 6), which are hereinafter referred to as front and back sides 140, 142. The front and back sides 140, 142 are on opposite sides of the resealable enclosure 104. The front and back sides 140, 142 are coupled to each other along a bottom edge 144 (FIG. 5) and opposite side edges 146, 148. The front and back sides 140, 142 are coupled to each other along a top edge 145. In some embodiments, two sides are coupled to each other by heat sealing the material of the two sides together. Alternatively or in addition to heat-sealing, other methods of coupling the two sides may include at least one of welding (e.g., ultrasonic), crimping, folding, tucking, or using an adhesive or gummed tape. The resealable enclosure 104 may comprise, for example, a polyethylene (e.g., low density polyethylene (LDPE), medium density polyethylene (MDPE), high density polyethylene (HDPE), or a blend thereof) or other polyolefins. In addition to blends of different materials, the resealable enclosure 104 may comprise co-extrusions.

Respective lips 141, 143 (shown in FIG. 5) of the front and back sides 140, 142 may extend beyond a separable seal 196 along the top edge 145 that bonds the front and back sides 140, 142. In certain embodiments, the separable seal 196 is a breakable seal 196 that is configured to be torn or ruptured when the resealable enclosure is opened. In other embodiments, the seal 196 is a peelable seal 196 in which the two inner surfaces may peel apart from one another when the resealable enclosure is opened.

To initially open the resealable enclosure 104, the lips 141, 143 of the front and back sides 140, 142 may be gripped by a user and pulled apart, thereby opening the separable seal 196 and separating the front and back sides 140, 142. When separated, the front and back sides 140, 142 define an inner opening 164 (shown in FIG. 8). As another example for opening the resealable enclosure 104, the resealable enclosure 104 could be pinch-gripped and opened by grasping the front and back sides 140, 142 below the separable seal 196 and then pulling the separable seal 196 apart.

Optionally, a backstop seal 162 (shown in FIGS. 5 and 6) may also secure the front and back sides 140, 142 to each other. As shown, the backstop seal 162 may extend in a direction that is perpendicular to the top edge 145 and the separable seal 196. The backstop seal 162 is configured to stop the separation of the front and back sides 140, 142 as the front and back sides 140, 142 are pulled apart. As such, the inner opening 164 (FIG. 8) of the resealable enclosure 104 may be configured to have a predetermined size and shape.

Figure 15:
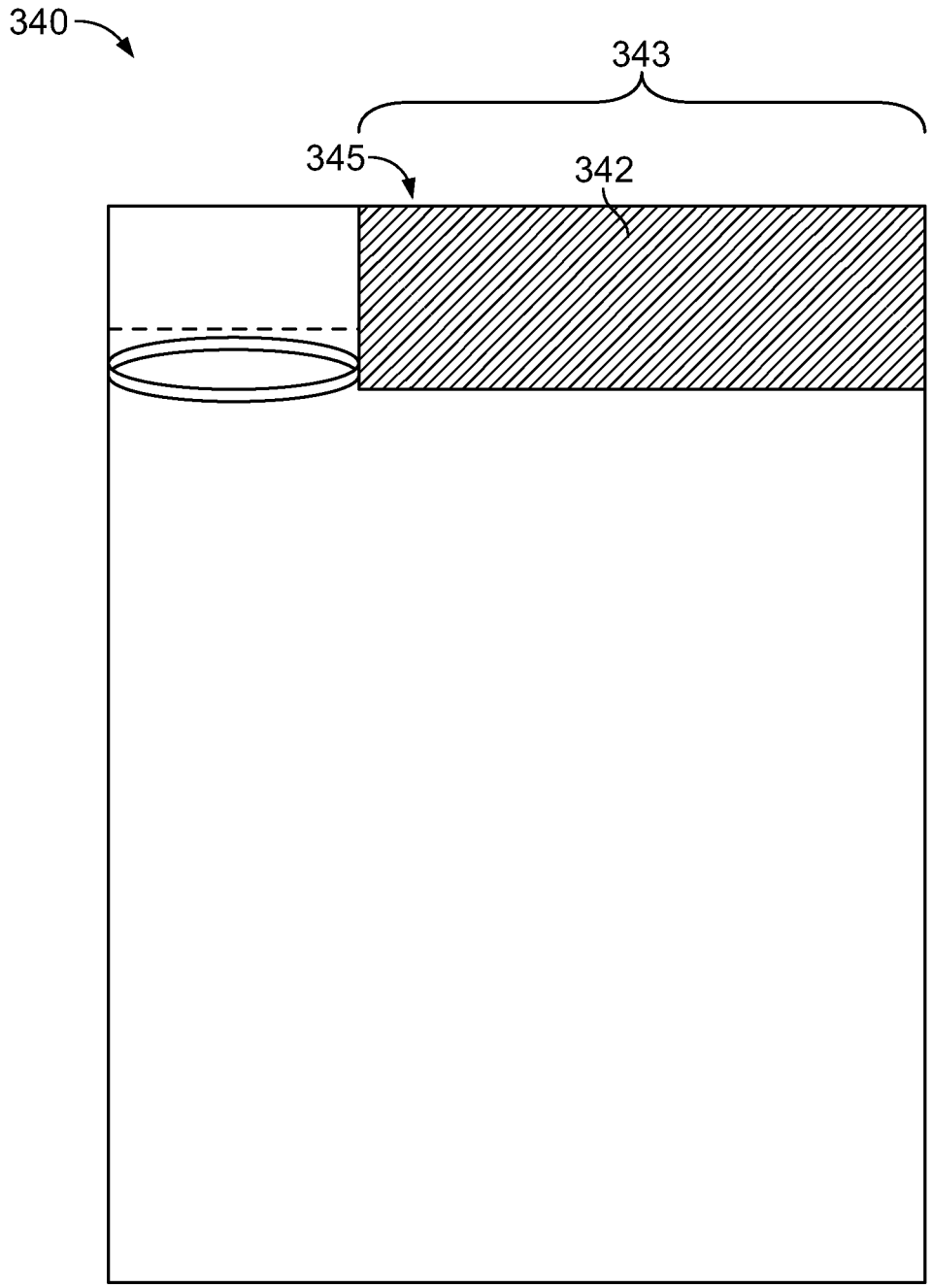
FIG. 15 illustrates a resealable enclosure having a backstop seal that extends across an entire non-opening portion of the resealable enclosure in accordance with an embodiment.

In some embodiments, the backstop seal could be configured so that the contents held by the resealable enclosure are not collected along the top edge in a space partially defined by the backstop seal. For example, FIG. 15 illustrates a resealable enclosure 340 that is similar to the resealable enclosure 104 (FIG. 1) and has a backstop seal 342 that extends along a top edge 345. The backstop seal 342 extends across an entire non-opening portion 343 of the top edge 345 of the resealable enclosure 340. When the resealable enclosure 340 is, for example, positioned for pouring or inverted during shipping, the contents are less likely to gather or become trapped along the top edge 345 of the resealable enclosure 340. For some known resealable enclosures, trapped contents may require shaking or re-positioning of the resealable enclosure (e.g., quickly returning the resealable enclosure to an upright position to allow the contents along the top to fall). As such, the backstop seal 342 of the resealable enclosure 340 could reduce frustration for a user.

Optionally, the resealable enclosure 104 could include lines of weakness (not shown) that enable removing a portion of the resealable enclosure 104. The lines of weakness could be similar to the lines of weakness 191-193 (FIGS. 1 and 2). Alternatively or in addition to the lines of weakness, the side edge 146 may include tear notches that indicate where a user may begin removing a portion of the resealable enclosure 104.

In the illustrated embodiment, the resealable enclosure 104 includes a gusseted bag in which each of the side edges 146, 148 is a gusseted side edge. A gusseted side edge includes a gusseted portion or fold 160 that is configured to extend inwardly when, for example, the resealable enclosure 104 is unopened. As described herein, the gusseted side edge 146 may move from an inward state to an outward state. In other embodiments, only one of the side edges is a gusseted side edge. Although the illustrated embodiment includes a gusseted enclosure, other types of enclosures may be used that allow operation of a resealer. For example, the resealable enclosure may include a flat bag (or flat poly bag), a header bag, a stand-up pouch (e.g., Doy-pack or flat-bottom pouch), or a reclosable pouch (e.g., zip-top pouch). Stated differently, the resealable enclosure 104 may not include a gusset or gusseted side edge.

Figure 7:
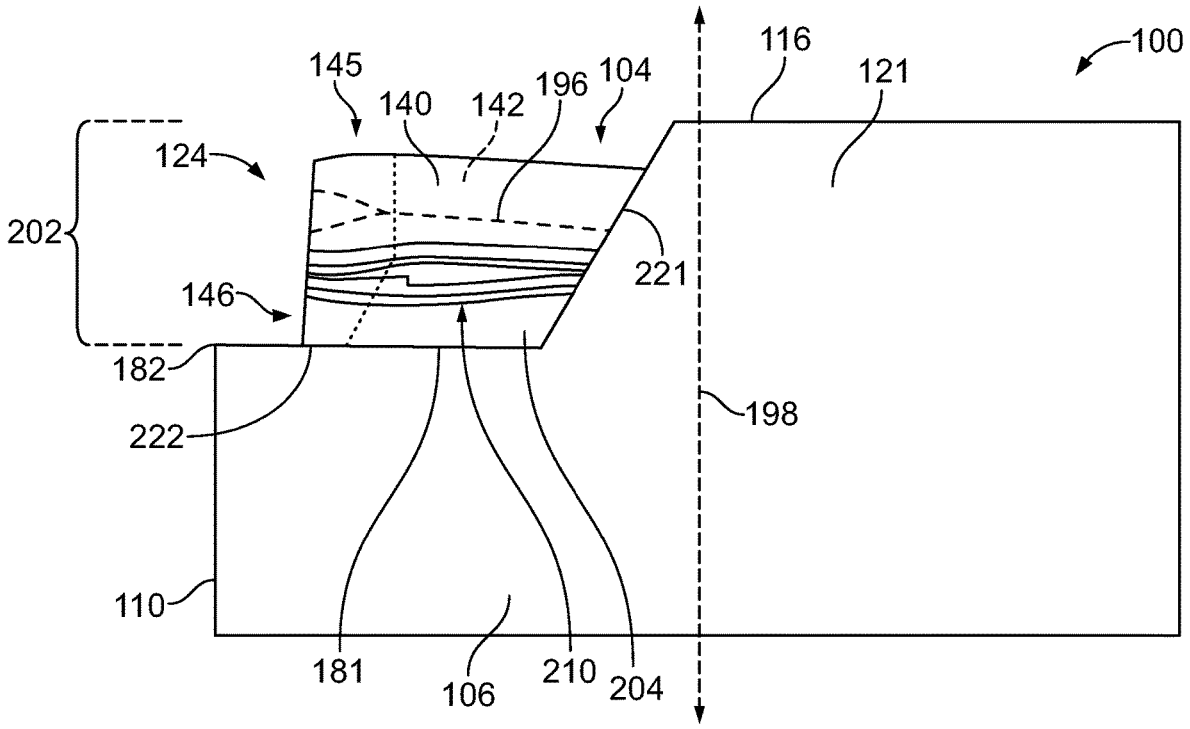
FIG. 7 is a side view of a portion of the enclosure assembly of FIG. 1 prior to the resealable enclosure being initially opened.
Figure 8:
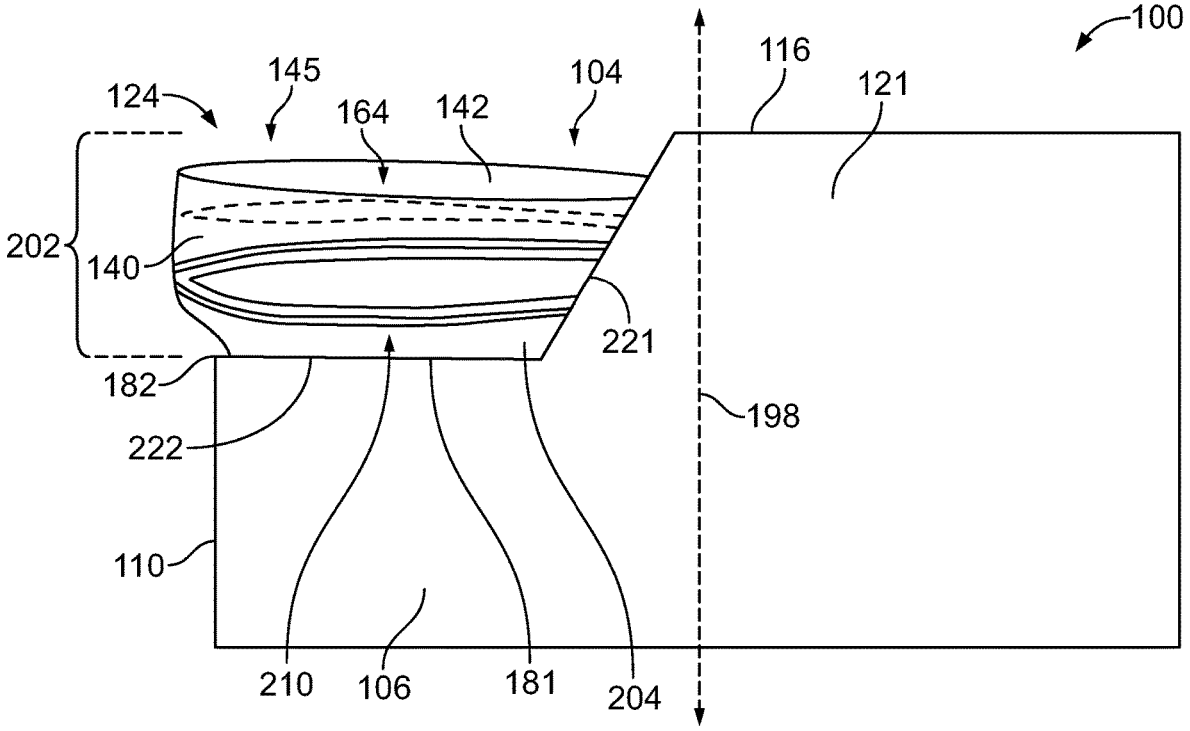
FIG. 8 is a side view of the portion of the enclosure assembly shown in FIG. 7 after the resealable enclosure has been initially opened.

FIG. 7 is a side view of a portion of the enclosure assembly 100 after the breakable section 120 (FIG. 1) has been removed but prior to the resealable enclosure 104 being initially opened. FIG. 8 is a side view of the portion of the enclosure assembly 100 after the resealable enclosure 104 has been initially opened and the inner opening 164 is formed. As described herein, a user may separate the separable seal 196 (FIG. 7) by pulling the front and back sides 140, 142 of the resealable enclosure 104 apart. The separable seal 196 may be formed by heat-sealing the front and back sides 140, 142 together using a coating that forms a bond. The bond is configured to allow the front and back sides 140, 142 to be separated by a user.

The breakable section 120 (FIG. 1) of the outer box enclosure 102 reveals an accessible space 202 when the breakable section 102 is moved relative to the remainder 121 of the outer box enclosure 102. The accessible space 202 represents a portion of the interior volume 105 (FIG. 1) that may be accessed by the user to engage and manipulate the resealable enclosure 104. In the illustrated embodiment, the accessible space 202 represents a former portion of the enclosed interior volume 105 that is now accessible without requiring the user to insert his or her entire hand through the outer opening 124. For example, a user's fingers may grip the resealable enclosure 104 within the accessible space 202 to form the inner opening 164 (FIG. 8). The remaining portion of the interior volume 105 that is generally not accessible to the user may be referred to as the covered or enclosed space.

The outer opening 124 is defined by the edge 181 of the front panel 106, the edge 183 (FIG. 4) of the back panel 108, and the edge 182 of the lateral panel 110. The edge 181 and the edge 183 may be non-linear edges. For example, the edge 181 includes a depth-changing segment 221 and a horizontal segment 222. A reference axis 198 extends through the outer box enclosure 102. The reference axis 198 extends in a direction from the bottom panel 116 to the top panel 114 and through a geometric center of the outer box enclosure 102. The depth-changing segment 221 is linear and extends at least partially along a reference axis 198. The horizontal segment 222 extends perpendicular to the reference axis 198. Although the depth-changing and horizontal segments 221, 222 are linear in the illustrated embodiment, the edge 181 may be curved and/or the depth-changing and horizontal segments 221, 222 may be non-linear in other embodiments.

An operative portion 204 of the resealable enclosure 104 is shown in FIGS. 7 and 8. The operative portion 204 is disposed within and occupies a portion of the accessible space 202. The operative portion 204 represents the portion of the resealable enclosure 104 that may be initially opened and repeatedly opened and sealably closed by the user. In some embodiments, the operative portion 204 is configured to be positioned within the accessible space 202 prior to opening the outer box enclosure 102 such that the operative portion 204 is also revealed to the user when the breakable section 120 (FIG. 1) is moved. With only the operative portion 204 being positioned within the accessible space 202, a user may quickly understand that the operative portion 204 should be used for pouring contents from the resealable enclosure 104.

In some embodiments, the breakable section 120 (FIG. 1) and the resealable enclosure 104 are sized and shaped relative to each other such that the operative portion 204 of the resealable enclosure 104 is viewable to a user after the breakable section 120 is moved. For example, the resealable enclosure 104 clears the edge 181 and is visible to a user when viewed from the side (as shown in FIGS. 7 and 8). More specifically, the operative portion 204 is viewable when a user faces the front panel 106, when a user faces the back panel 108 (FIG. 2), or when a user faces the lateral panel 110. The operative portion 204 would also be viewable if the user faced the top panel 116.

In the illustrated embodiment, the breakable section 120 is a three-dimensional section of the outer box enclosure 102 that is sized relative to the resealable enclosure 104 so that only a portion of the resealable enclosure 104 is viewable when the outer box enclosure 102 is upright (e.g., sitting on a table) and the breakable section 120 has been removed. In other embodiments, such as the embodiment illustrated in FIGS. 13-14, the breakable section 120 is essentially a two-dimensional section of the outer box enclosure. Nonetheless, the operative portion 204 is the first portion of the resealable enclosure 104 that is identified by the user when the resealable enclosure 104 is viewable.

As shown in FIGS. 7 and 8, the operative portion 204 may include a resealer 210. The resealer 210 enables the user to repeatedly open the inner opening 164 and sealably close the inner opening 164. The resealer 210 may be viewable by the user when the operative portion 204 is positioned within the accessible space 202. As such, the user may quickly identify that the resealer 210 should be used to reseal the resealable enclosure 104 after removing contents therefrom.

In the illustrated embodiment, the resealer 210 is formed by a single intermeshable closure member 212. With reference to FIG. 4, the intermeshable closure member 212 may be affixed to and wrap from the front side 140 around the side edge 146, and onto the back side 142. The intermeshable closure member 212 is affixed to an interior surface 103 of the resealable enclosure 104. Prior to initially opening the resealable enclosure 104, the intermeshable closure member 212 may be mostly or entirely uncoupled with itself. For example, the intermeshable closure member 212 may be entirely uncoupled with itself or may be coupled together at opposite ends of the intermeshable closure member 212.

In other embodiments, the resealer 210 (or the intermeshable closure member 212) may have a portion that is coupled to itself prior to opening. For example, the intermeshable closure member 212 may be coupled to itself proximate to the backstop seam 162 (FIG. 6). Optionally, the intermeshable closure member 212, prior to opening, is coupled to itself in a manner that is similar or identical to how the intermeshable closure member 212 couples to itself after opening as described below with respect to FIG. 10.

Alternatively or in addition to the intermeshable closure member 212, other resealers may be used. For example, in other embodiments, the resealer 210 may include at least one of parallel fastener strips, cooperating adhesive strips, hook-and-loop fastener elements, or a slider.

Figure 9:
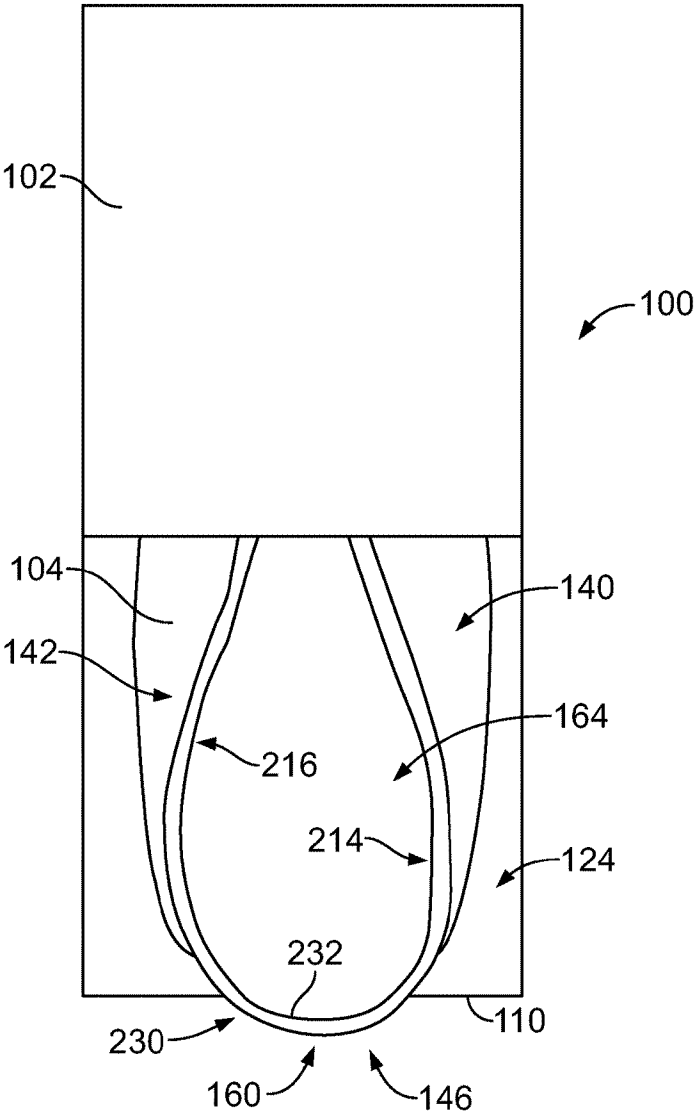
FIG. 9 is a top view of the portion of the enclosure assembly shown in FIG. 7 after the resealable enclosure has been initially opened.

FIG. 9 is a top view of a portion of the enclosure assembly 100 after the resealable enclosure 104 has been initially opened. As shown, the inner opening 164 may be generally aligned with the outer opening 124. The contents of the resealable enclosure 104 are configured to pass through the inner opening 164. For example, the contents may be poured through the inner opening 164 when the enclosure assembly 100 is partially inverted.

As described herein, the side edge 146 may include the gusseted section 160. In such embodiments, the gusseted section 160 may be configured to be displaced from an inward state (shown in FIGS. 5 and 6) to an outward state (shown in FIG. 9) to form a spout 230. The spout 230 is positionable adjacent to or within the accessible space 202. In some embodiments, the spout 230 has a lip 232 that includes at least a portion of the side edge 146. As shown, the lip 232 clears the lateral panel 110 of the outer box enclosure 102. In other embodiments, however, the lip 232 does not clear the lateral panel 110.

The spout 230 corresponds to an increased dimension (or width) of the resealable enclosure 104. As described above with respect to FIG. 5, the resealable enclosure 104 has a width 199 that extends between the side edges 146, 148. When the resealable enclosure 104 includes the spout 230, the width 199 of the resealable enclosure 104 is greater than the width 199 of the resealable enclosure 104 prior to initially opening the resealable enclosure 104. The side edge 146 extends toward the lateral panel 110 when the side edge 146 forms the spout 230. A bottom portion of the side edge 146 extending from the bottom edge 144 and toward the top edge 145 may extend parallel to the lateral panel 110. When the spout 230 is formed, a top portion of the side edge 146 extends toward the side edge 146, thereby forming the spout 230.

To reseal the resealable enclosure 104, the user presses the front and back sides 140, 142 of the resealable enclosure 104 toward each other. For example, the intermeshable closure member 212 may be configured to couple with itself at a first area 214 of the intermeshable closure member 212 that is on the front side 140 of the resealable enclosure 104 and at a different, second area 216 of the intermeshable closure member that is on the back side 142 of the resealable enclosure 104 to close the resealable enclosure 104.

Figure 10:
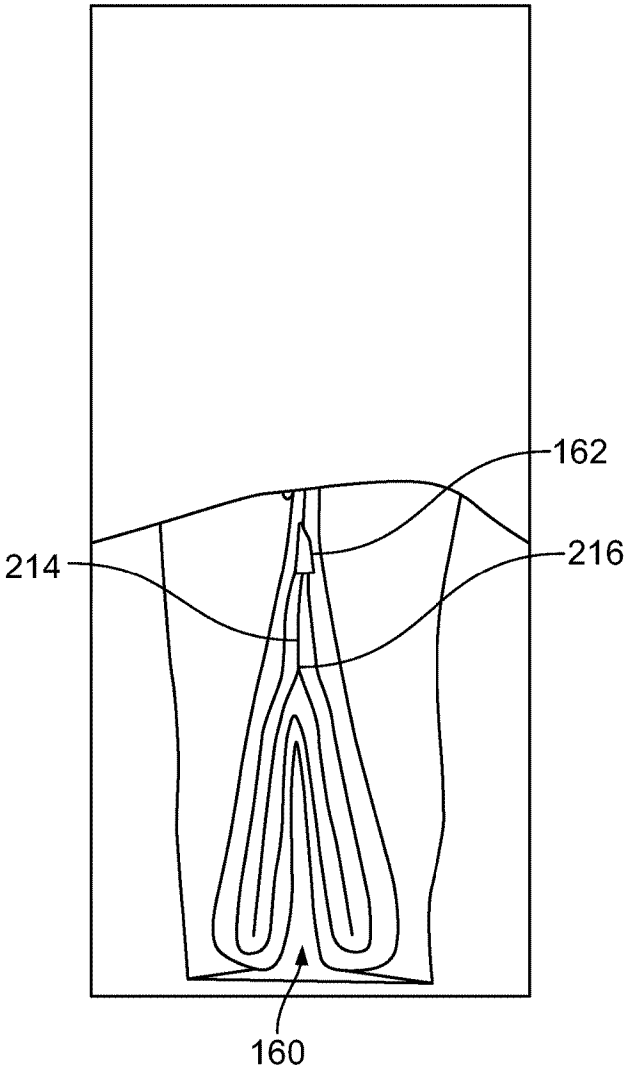
FIG. 10 is top view of a portion of the enclosure assembly of FIG. 1 after initially being opened and then re-sealed in a gusseted configuration.

FIG. 10 is a top view of the enclosure assembly 100 with a section of the top panel 114 removed for illustrative purposes. In some embodiments, prior to resealing the resealable enclosure 104, the user may move the gusseted section 160 from the outward state to the inward state and then press the front and back sides 140, 142 resealable enclosure 104 to each other, thereby coupling itself at the first and second areas 214, 216. Because of the gusseted section 160 having the inward state, the first area 214 may couple with itself and the second area 216 may couple with itself. As shown in FIG. 10, the enclosure assembly 100 has been re-sealed (or sealably closed) in a gusseted configuration.

In some embodiments, the intermeshable closure member 212 may be entirely uncoupled with itself when the inner opening 164 (FIG. 9) is used to pass contents therethrough. In other embodiments, however, the intermeshable closure member 212 may be coupled at opposite ends of the intermeshable closure member 212. For example, the backstop seal 162 may be formed by joining opposite ends of the single intermeshable closure member 212. The opposite ends of the intermeshable closure member 212 could be fused together such that the backstop seal 162 is not required, or the opposite ends of the intermeshable closure member 212 could be fused to each other and to the backstop seal 162.

Figure 12:
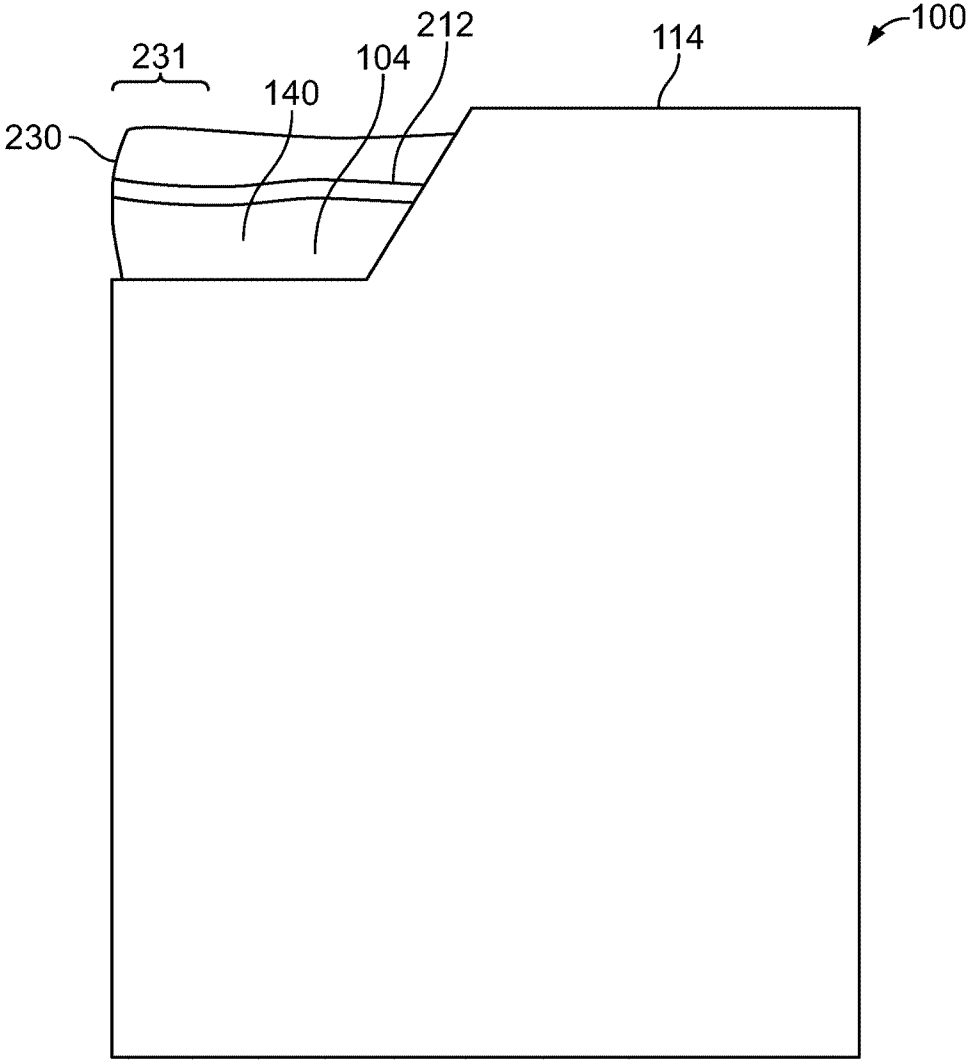
FIG. 12 is a side view of the enclosure assembly of FIG. 1 after initially being opened and then re-sealed in a flat configuration.
Figure 11:
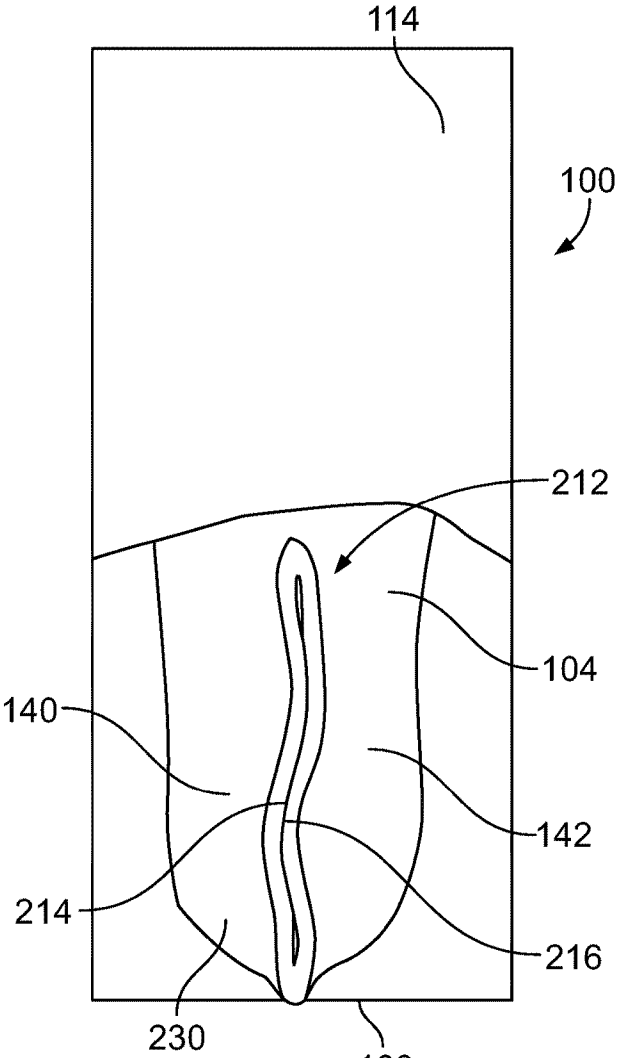
FIG. 11 is top view of a portion of the enclosure assembly of FIG. 1 after initially being opened and then re-sealed in a flat configuration.

FIGS. 11 and 12 illustrate a top view and a side view of the enclosure assembly 100. In FIG. 11, a portion of the top panel 114 has been removed to illustrate details of the resealable enclosure 104. In some embodiments, the resealable enclosure 104 may be re-sealed or sealably closed without moving the gusseted section 160 from the outward state to the inward state. Instead, the gusseted section 160 may be in the outward state as the front and back sides 140, 142 are pressed toward each other. More specifically, the intermeshable closure member 212 couples with itself at the first area 214 (FIG. 11) and at the second area 216 (FIG. 11) to close the resealable enclosure 104. As shown, the enclosure assembly 100 has been re-sealed (or sealably closed) in a flat or non-gusseted configuration. In such embodiments, the closed operative portion 204 includes a spout-like side profile 231 (FIG. 12).

Figure 13:
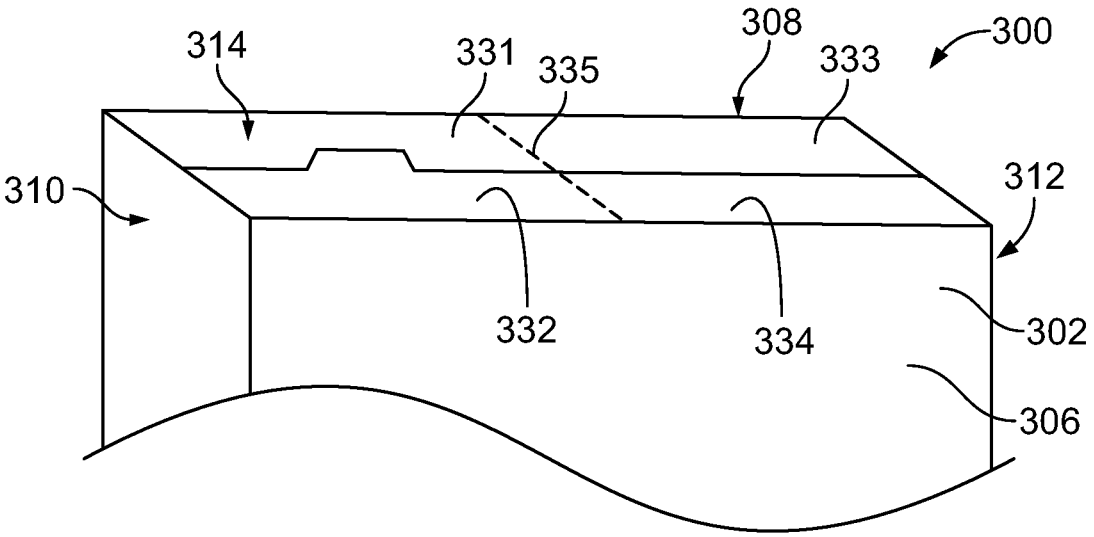
FIG. 13 is a side perspective view of an enclosure assembly having an outer box enclosure in accordance with an embodiment that includes hinged panel sections.
Figure 14:
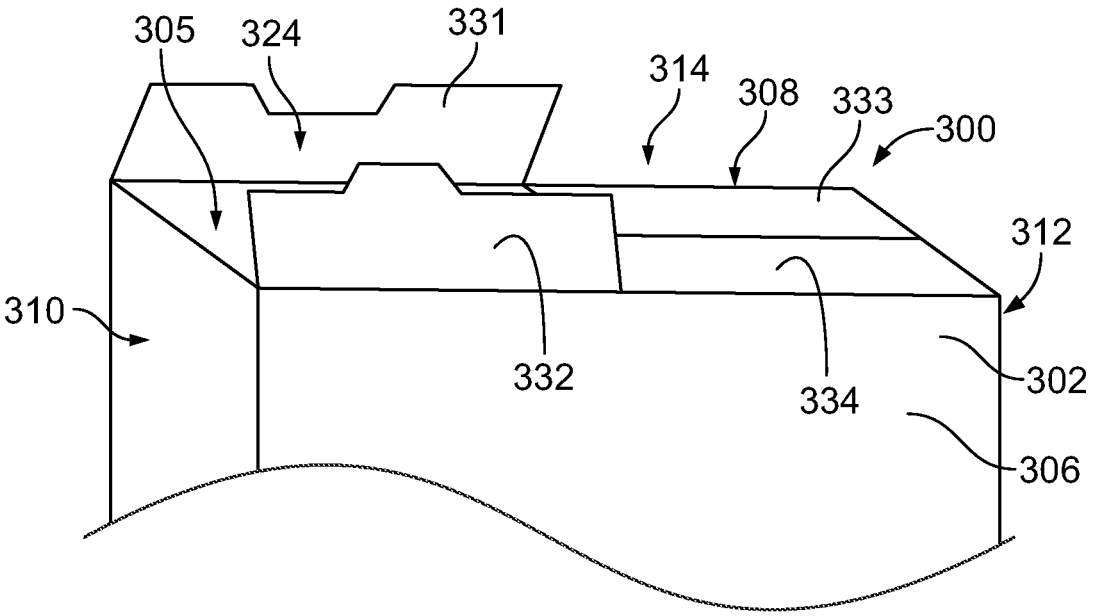
FIG. 14 is a side perspective view of the enclosure assembly of FIG. 13 in which the hinged panel sections are opened.

FIGS. 13 and 14 illustrate side perspective views of an enclosure assembly 300 having an outer box enclosure 302. In FIG. 13, the outer box enclosure 302 is closed. In FIG. 14, the outer box enclosure 302 is opened. The enclosure assembly 300 includes features that may be similar or identical to the features of the enclosure assembly 100 (FIG. 1). As shown, the outer box enclosure 300 includes a front panel 306, a back panel 308, opposite lateral side panels 310, 312, and a top panel 314. The top panel 314 is at least partially formed by panel sections 331-334. The panel sections 331-334 include movable hinged panel sections 331, 332 and static panel sections 333, 334. A line of weakness 335 extends from the front panel 306, across the top panel 314, and to the back panel 308.

The hinged panel sections 331, 332 are configured to separate and swing open to form an outer opening 324 (FIG. 14). The outer opening 324 provides access to the interior volume 305 of the outer box enclosure 302. Although not shown, the enclosure assembly 300 may include a resealable enclosure (not shown) that may be similar or identical to the resealable enclosure 104 (FIG. 1). In some embodiments, the resealable enclosure may be sized and shaped such that an operative portion of the resealable enclosure may extend through and clear the outer opening 324.

Figure 16:
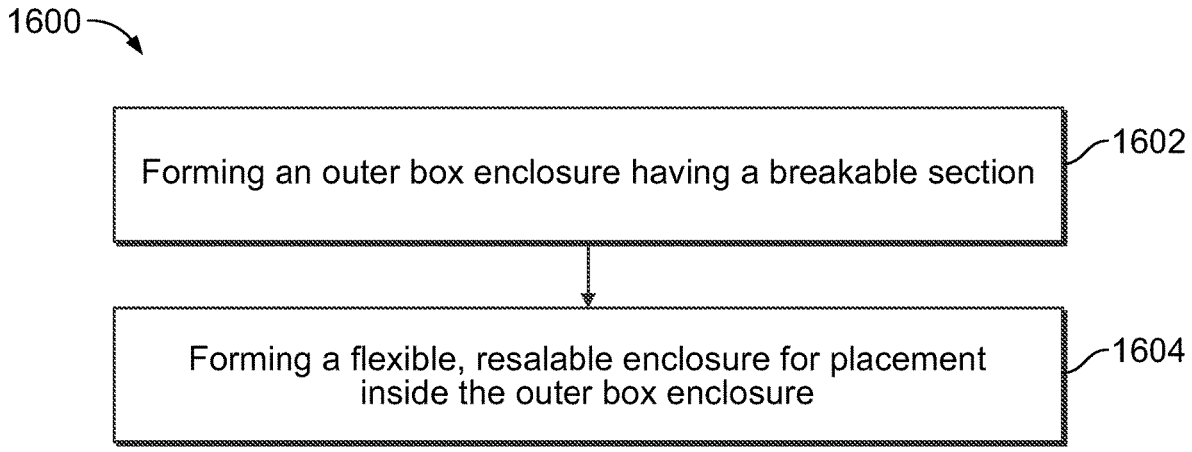
FIG. 16 illustrates a flowchart of one example of a method for providing an enclosure assembly having a resealable enclosure within an outer box enclosure.

FIG. 16 illustrates a flowchart of one example of a method 1600 for providing an enclosure assembly having a resealable enclosure within an outer box enclosure. The method 1600 may be used to provide one or more embodiments of the enclosure assemblies described and/or shown herein. At 1602, an outer box enclosure is formed, with the enclosure having a breakable section. The outer box enclosure may include a portion that may be moved to reveal an accessible space inside the outer box enclosure. This portion may be a single line that provides an opening into the outer box enclosure through a top, side, front, or back of the outer box assembly. Alternatively, the portion may be several lines that extend through multiple sides or panels of the outer box assembly (e.g., through one lateral panel, the front panel, and the back panel to form a hinge in the top panel; or through one lateral panel, the front panel, the top panel, and the back panel to form an annular path and allow for the portion to be completely removed from the outer box enclosure).

At 1602, a flexible, resealable enclosure is formed for placement within the outer box enclosure. The resealable enclosure can be initially opened by separating a portion of the resealable enclosure to form an inner opening along a top edge of the resealable enclosure. Contents may be passable through the inner opening of the resealable enclosure. The resealable enclosure may include a resealer that permits a user to open the inner opening and sealably close the inner opening.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are example embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the inventive subject matter and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

As used herein, an element or step recited in the singular and proceeded with the word "a" or "an" should be understood as not excluding plural of said elements or steps, unless such exclusion is explicitly stated. Furthermore, references to "one embodiment" of the present inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

What is claimed is:

1. An enclosure assembly comprising:

an outer box enclosure having opposite front and back panels and opposite lateral panels coupled by a top panel, the top panel including a front hinged panel section coupled with the front panel at a front hinge interface, the top panel including a back hinged panel section coupled with the back panel at a back hinge interface, the outer box enclosure having a line of weakness along the top panel between the opposite lateral panels and extending from the front panel to the back panel, the line of weakness separating the front hinged panel section into a moveable front hinged panel section and a static front hinged panel section, the line of weakness separating the back hinged panel section into a moveable back hinged panel section and a static back hinged panel section; and a flexible, resealable enclosure disposed within the outer box enclosure, the resealable enclosure having opposite front and back sides coupled to each other along a bottom edge and opposite first and second side edges, the resealable enclosure having a resealer formed by a single intermeshable closure member that is affixed to and wraps from the front side, around the first side edge, and onto the back side proximate to an upper edge of the resealable enclosure, the resealable enclosure having a peelable seal disposed between the upper edge of the resealable enclosure and the resealer, the peelable seal bonding the front side of the resealable enclosure to the back side of the resealable enclosure from the first side edge to the second side edge of the resealable enclosure, the peelable seal spaced apart from the upper edge of the resealable enclosure to form lips in the resealable enclosure, the lips of the resealable enclosure configured to be gripped and pulled apart to open the peelable seal above the resealer to form an inner opening that provides access to the resealer, the resealable enclosure also including a backstop seal securing the front and back sides together, the backstop seal extending downward from the upper edge of the resealable enclosure along a first direction that is perpendicular to the upper edge and perpendicular to the peelable seal, the backstop seal configured to stop separation of the front and back sides of the resealable enclosure and to define a size of the inner opening formed by pulling the lips of the resealable enclosure apart, wherein, prior to initially opening the resealable enclosure, the intermeshable closure member is predominantly uncoupled with itself, wherein, the intermeshable closure member is configured to couple with itself at a first area of the intermeshable closure member that is on the front side of the resealable enclosure and at a different, second area of the intermeshable closure member that is on the back side of the resealable enclosure to close the resealable enclosure, wherein the moveable front hinged panel section of the front hinged panel section and the moveable back hinged panel section of the back hinged panel section are configured to pivot away from each other to open the outer box enclosure and provide access to the resealable enclosure while the static front hinged panel section of the front hinged panel section and the static back hinged panel section of the back hinged panel section remain in place to keep a remainder of the top panel closed, wherein the moveable front hinged panel section of the front hinged panel section and the moveable back hinged panel section of the back hinged panel section are configured to pivot away from each other to open the outer box enclosure at a top opening in the top panel, wherein the top opening in the top panel of the outer box enclosure is bounded by an upper edge of a first lateral panel of the lateral panels, a first portion of the front hinge interface that extends along the front hinge interface from the first lateral panel to the line of weakness, the line of weakness, and a second portion of the back hinge interface that extends along the back hinge interface from the first lateral panel to the line of weakness.

2. The enclosure assembly of claim 1, wherein the intermeshable closure member extends from a first end on the front side of the resealable enclosure to an opposite, second end on the back side of the resealable enclosure.

3. The enclosure assembly of claim 2, wherein the front side and the back side of the resealable enclosure are sealed to each other by the backstop seal in a location that is proximate to the first end and the second end of the intermeshable closure member.

4. The enclosure assembly of claim 2, wherein the first end and the second end of the intermeshable closure member are located at the backstop seal.

5. The enclosure assembly of claim 4, wherein the backstop seal extends along the first direction that is perpendicular to the upper edge and perpendicular to the peelable seal to below the resealer, the backstop seal also laterally extending along a second direction that is parallel to the upper edge and parallel to the peelable seal from the first end and the second end of the resealer to the second side edge of the resealable enclosure.

6. The enclosure assembly of claim 1, wherein the intermeshable closure member is configured to be re-coupled with itself after opening the resealable enclosure.

7. The enclosure assembly of claim 1, wherein the intermeshable closure member is configured to be re-coupled with itself in a gusseted configuration with the intermeshable closure member wrapping from the front side, around a gusseted section, and onto the back panel.

8. The enclosure assembly of claim 1, wherein the intermeshable closure member is configured to be re-coupled with itself in a configuration other than a gusseted configuration.

9. The enclosure assembly of claim 1, wherein the resealable enclosure forms a shape of the outer box enclosure by middle portions of the front and back sides of the resealable enclosure extending toward opposing interior surfaces of the front and back panels of the outer box enclosure and by end portions of the front and back sides extending toward an interior surface of one of the lateral panels of the outer box enclosure.

10. An enclosure assembly comprising:

an outer box enclosure having opposite front and back panels and opposite lateral panels, the front and back panels and the lateral panels coupled with each other by a top panel, the top panel including a front hinged panel section coupled with the front panel at a front hinge interface, the top panel including a back hinged panel section coupled with the back panel at a back hinge interface, the outer box enclosure having a line of weakness between the lateral panels and extending from the front panel to the back panel, the line of weakness separating the front hinged panel section into a moveable front hinged panel section and a static front hinged panel section, the line of weakness separating the back hinged panel section into a moveable back hinged panel section and a static back hinged panel section, wherein the outer box enclosure is configured to break along the line of weakness with the moveable front hinged panel section of the front hinged panel section and the moveable back hinged panel section of the back hinged panel section pivoting away from each other to form an outer opening along the top panel that extends from a first lateral panel of the lateral panels to the line of weakness while the static front hinged panel section of the front hinged panel section and the static back hinged panel section of the back hinged panel section remain in place to keep a remainder of the top panel closed, the outer opening in the outer box enclosure bounded by an upper edge of a first lateral panel of the lateral panels, a first portion of the front hinge interface that extends along the front hinge interface from the first lateral panel to the line of weakness, the line of weakness, and a second portion of the back hinge interface that extends along the back hinge interface from the first lateral panel to the line of weakness; and a flexible, resealable enclosure disposed within the outer box enclosure, the resealable enclosure having opposite front and back sides coupled to each other along a bottom edge, the resealable enclosure also including opposite first and second side edges extending between the front and back sides, wherein the resealable enclosure is configured to be initially opened by separating a peelable seal of a resealable enclosure, thereby forming an inner opening along the top edge through which contents of the resealable enclosure are poured, wherein the resealable enclosure includes a resealer that extends along the top edge from the first side edge toward the second side edge, the resealer permitting a user to open the inner opening and sealably close the inner opening, wherein the first side edge is configured to form a spout that defines a portion of the inner opening and that is positionable adjacent to or within the outer opening of the outer box enclosure, wherein the peelable seal is disposed between the top edge of the resealable enclosure and the resealer, the peelable seal bonding the front side of the resealable enclosure to the back side of the resealable enclosure from the first side edge to the second side edge of the resealable enclosure, the resealable enclosure also including a backstop seal securing the front and back sides together, the backstop seal extending downward from the upper edge of the resealable enclosure across the peelable seal along a first direction that is perpendicular to the upper edge and perpendicular to the peelable seal, the backstop seal also laterally extending along a second direction from the resealer to the second side edge of the resealable enclosure, the backstop seal configured to stop separation of the front and back sides of the resealable enclosure and to define a size of the inner opening.

11. The enclosure assembly of claim 10, wherein the resealable enclosure has a width extending between the first and second side edges, wherein the width of the resealable enclosure having the spout is greater than the width of the resealable enclosure prior to initially opening the resealable enclosure.

12. The enclosure assembly of claim 10, wherein the front and back panels are coupled through the lateral panels, the first side edge extending toward the first lateral panel while the first side edge forms the spout.

13. The enclosure assembly of claim 10, wherein the resealable enclosure has a width extending between the first and second side edges, the resealer extending only a portion of the width between the first and second side edges, the top edge being closed for a remaining portion of the top edge.

14. The enclosure assembly of claim 10, wherein the peelable seal is spaced apart from the top edge of the resealable enclosure to form lips in the resealable enclosure, the lips of the resealable enclosure configured to be gripped and pulled apart to open the peelable seal above the resealer to form the inner opening that provides access to the resealer.

15. The enclosure assembly of claim 10, wherein the resealer is elongated from a first end to a second end, each of the first end and the second end located at the backstop seal.

16. A method comprising:

forming an outer box enclosure having opposite front and back panels and opposite lateral panels coupled by a top panel, the top panel including a front hinged panel section coupled with the front panel at a front hinge interface, the top panel including a back hinged panel section coupled with the back panel at a back hinge interface, the outer box enclosure having a line of weakness along the top panel between the opposite lateral panels and extending from the front panel to the back panel, the line of weakness separating the front hinged panel section into a moveable front hinged panel section and a static front hinged panel section, the line of weakness separating the back hinged panel section into a moveable back hinged panel section and a static back hinged panel section; and forming a flexible, resealable enclosure for placement within the outer box enclosure, the resealable enclosure having opposite front and back sides coupled to each other along a bottom edge and opposite first and second side edges, the resealable enclosure having a resealer formed by a single intermeshable closure member that is affixed to and wraps from the front side, around at least one of the side edges, and onto the back side proximate to an upper edge of the resealable enclosure, the resealable enclosure formed to have a peelable seal disposed between the upper edge of the resealable enclosure and the resealer, the peelable seal bonding the front side of the resealable enclosure to the back side of the resealable enclosure from the first side edge to the second side edge of the resealable enclosure, the peelable seal spaced apart from the upper edge of the resealable enclosure to form lips in the resealable enclosure, the lips of the resealable enclosure formed to be gripped and pulled apart to open the peelable seal above the resealer to form an inner opening that provides access to the resealer, the resealable enclosure also formed to have a backstop seal securing the front and back sides together, the backstop seal extending downward from the upper edge of the resealable enclosure along a first direction that is perpendicular to the upper edge and perpendicular to the peelable seal, the backstop seal formed to stop separation of the front and back sides of the resealable enclosure and to define a size of the inner opening formed by pulling the lips of the resealable enclosure apart, wherein, prior to initially opening the resealable enclosure, the intermeshable closure member is predominantly uncoupled with itself, wherein, the intermeshable closure member is configured to couple with itself at a first area of the intermeshable closure member that is on the front side of the resealable enclosure and at a different, second area of the intermeshable closure member that is on the back side of the resealable enclosure to close the resealable enclosure, wherein the moveable front hinged panel section of the front hinged panel section and the moveable back hinged panel section of the back hinged panel section are configured to pivot away from each other to open the outer box enclosure and provide access to the resealable enclosure while the static front hinged panel section of the front hinged panel section and the static back hinged panel section of the back hinged panel section remain in place to keep a remainder of the top panel closed, wherein the moveable front hinged panel section of the front hinged panel section and the moveable back hinged panel section of the back hinged panel section are configured to pivot away from each other to open the outer box enclosure at a top opening in the top panel, wherein the top opening in the top panel of the outer box enclosure is bounded by an upper edge of a first lateral panel of the lateral panels, a first portion of the front hinge interface that extends along the front hinge interface from the first lateral panel to the line of weakness, the line of weakness, and a second portion of the back hinge interface that extends along the back hinge interface from the first lateral panel to the line of weakness.

17. The method of claim 16, wherein the resealable enclosure is formed such that the intermeshable closure member extends from a first end on the front side of the resealable enclosure to an opposite, second end on the back side of the resealable enclosure.

18. The method of claim 16, wherein the first end and the second end of the intermeshable closure member are formed to be located at the backstop seal.

19. The method of claim 16, wherein the intermeshable closure member is formed to extend from a first end on the front side of the resealable enclosure to an opposite, second end on the back side of the resealable enclosure.

20. The method of claim 19, wherein the backstop seal is formed to extend along the first direction that is perpendicular to the upper edge and perpendicular to the peelable seal to below the resealer, the backstop seal formed to not laterally extend along a second direction that is parallel to the upper edge and parallel to the peelable seal from the first end and the second end of the resealer to the second side edge of the resealable enclosure.

* * * * *